US009615189B2

(12) United States Patent
Copt et al.

(10) Patent No.: US 9,615,189 B2
(45) Date of Patent: Apr. 4, 2017

(54) ARTIFICIAL EAR APPARATUS AND ASSOCIATED METHODS FOR GENERATING A HEAD RELATED AUDIO TRANSFER FUNCTION

(71) Applicants: Ryan Copt, Port St. Lucie, FL (US); Joseph Butera, III, Stuart, FL (US); Robert Summers, III, Port St. Lucie, FL (US)

(72) Inventors: Ryan Copt, Port St. Lucie, FL (US); Joseph Butera, III, Stuart, FL (US); Robert Summers, III, Port St. Lucie, FL (US)

(73) Assignee: Bongiovi Acoustics LLC, Port St. Lucie, FL (US)

( * ) Notice: Subject to any disclaimer, the term of this patent is extended or adjusted under 35 U.S.C. 154(b) by 87 days.

(21) Appl. No.: 14/485,145

(22) Filed: Sep. 12, 2014

(65) Prior Publication Data

US 2016/0044436 A1 Feb. 11, 2016

Related U.S. Application Data

(60) Provisional application No. 62/035,025, filed on Aug. 8, 2014.

(51) Int. Cl.

| | |
|---|---|
| ***H04R 5/00*** | (2006.01) |
| ***H04S 7/00*** | (2006.01) |
| *H04R 1/10* | (2006.01) |
| *H04R 1/34* | (2006.01) |
| *H04R 5/027* | (2006.01) |

(Continued)

(52) U.S. Cl.

CPC ..... *H04S 7/302* (2013.01); *H04R 1/1075* (2013.01); *H04R 1/342* (2013.01); *H04R 5/027* (2013.01); *H04R 5/033* (2013.01); *H04R 2201/107* (2013.01); *H04S 1/007* (2013.01); *H04S 2400/01* (2013.01); *H04S 2420/01* (2013.01)

(58) Field of Classification Search

CPC ... H04S 7/302; H04S 2420/01; H04R 1/1016; H04R 5/027

USPC ..... 381/310, 311, 26, 380

See application file for complete search history.

(56) References Cited

U.S. PATENT DOCUMENTS

| | | |
|---|---|---|
| 3,795,876 A | 3/1974 | Takahashi et al. |
| 3,813,687 A | 5/1974 | Geil |

(Continued)

FOREIGN PATENT DOCUMENTS

| | | |
|---|---|---|
| AU | 2005274099 | 10/2010 |
| AU | 20070325096 | 4/2012 |

(Continued)

OTHER PUBLICATIONS

NovaSound Int., http://www.novasoundint.com/new_page_t.htm, 2004.

*Primary Examiner* — Paul S Kim
*Assistant Examiner* — Katherine Faley
(74) *Attorney, Agent, or Firm* — Malloy & Malloy, P.L.

(57) ABSTRACT

The present invention provides for an apparatus, system, and method for generating a head related audio transfer function in real time. Specifically, the present invention utilizes unique structural components including a tragus structure and an antihelix structure in connection with a microphone in order to communicate the location of a sound in three dimensional space to a user.

2 Claims, 5 Drawing Sheets

(51) Int. Cl.
*H04R 5/033* (2006.01)
*H04S 1/00* (2006.01)

(56) References Cited

U.S. PATENT DOCUMENTS 4,162,462 A 7/1979 Endoh et al.
4,184,047 A 1/1980 Langford
4,218,950 A 8/1980 Uetrecht
4,226,533 A 10/1980 Snowman
4,257,325 A 3/1981 Bertagni
4,353,035 A 10/1982 Schröder
4,356,558 A 10/1982 Owen et al.
4,363,007 A 12/1982 Haramoto et al.
4,412,100 A 10/1983 Orban
4,517,415 A 5/1985 Laurence
4,538,297 A 8/1985 Waller
4,549,289 A 10/1985 Schwartz et al.
4,584,700 A 4/1986 Scholz
4,602,381 A 7/1986 Cugnini et al.
4,612,665 A 9/1986 Inami et al.
4,641,361 A 2/1987 Rosback
4,677,645 A 6/1987 Kaniwa et al.
4,696,044 A 9/1987 Waller, Jr.
4,701,953 A 10/1987 White
4,704,726 A 11/1987 Gibson
4,715,559 A 12/1987 Fuller
4,739,514 A 4/1988 Short et al.
4,815,142 A 3/1989 Imreh
4,856,068 A 8/1989 Quatieri, Jr. et al.
4,887,299 A 12/1989 Cummins et al.
4,997,058 A 3/1991 Bertagni
5,007,707 A 4/1991 Bertagni
5,073,936 A 12/1991 Gurike et al.
5,133,015 A 7/1992 Scholz
5,210,806 A 5/1993 Kihara et al.
5,239,997 A 8/1993 Guarino et al.
5,355,417 A 10/1994 Burdisso et al.
5,361,381 A 11/1994 Short
5,420,929 A 5/1995 Geddes et al.
5,463,695 A 10/1995 Werrbach
5,465,421 A 11/1995 McCormick et al.
5,467,775 A 11/1995 Callahan et al.
5,473,214 A 12/1995 Hildebrand
5,515,444 A 5/1996 Burdisso et al.
5,539,835 A 7/1996 Bertagni et al.
5,541,866 A 7/1996 Sato et al.
5,572,443 A 11/1996 Emoto et al.
5,615,275 A 3/1997 Bertagni
5,617,480 A 4/1997 Ballard et al.
5,638,456 A 6/1997 Conley et al.
5,640,685 A 6/1997 Komoda
5,671,287 A 9/1997 Gerzon
5,693,917 A 12/1997 Bertagni et al.
5,699,438 A 12/1997 Smith et al.
5,727,074 A 3/1998 Hildebrand
5,737,432 A 4/1998 Werrbach
5,828,768 A 10/1998 Eatwell et al.
5,832,097 A 11/1998 Armstrong et al.
5,838,805 A 11/1998 Warnaka et al.
5,848,164 A 12/1998 Levine
5,872,852 A 2/1999 Dougherty
5,901,231 A 5/1999 Parrella et al.
5,990,955 A 11/1999 Koz
6,058,196 A 5/2000 Heron
6,078,670 A 6/2000 Beyer
6,093,144 A * 7/2000 Jaeger ..... H04R 25/606 600/25
6,108,431 A 8/2000 Bachler
6,201,873 B1 3/2001 Dal Farra
6,202,601 B1 3/2001 Ouellette et al.
6,208,237 B1 3/2001 Saiki et al.
6,263,354 B1 7/2001 Gandhi
6,285,767 B1 9/2001 Klayman
6,292,511 B1 9/2001 Goldston et al.
6,317,117 B1 11/2001 Goff
6,318,797 B1 11/2001 Böhm et al.
6,332,029 B1 12/2001 Azima et al.
6,518,852 B1 2/2003 Derrick
6,535,846 B1 3/2003 Shashoua
6,570,993 B1 5/2003 Fukuyama
6,618,487 B1 9/2003 Azima et al.
6,661,897 B2 12/2003 Smith
6,661,900 B1 12/2003 Allred et al.
6,772,114 B1 8/2004 Sluijter et al.
6,847,258 B2 1/2005 Ishida et al.
6,871,525 B2 3/2005 Withnall et al.
6,907,391 B2 6/2005 Bellora et al.
6,999,826 B1 2/2006 Zhou et al.
7,006,653 B2 2/2006 Guenther
7,016,746 B2 3/2006 Wiser et al.
7,024,001 B1 4/2006 Nakada
7,058,463 B1 6/2006 Ruha et al.
7,123,728 B2 10/2006 King et al.
7,254,243 B2 8/2007 Bongiovi
7,266,205 B2 9/2007 Miller
7,274,795 B2 9/2007 Bongiovi
7,519,189 B2 4/2009 Bongiovi
7,577,263 B2 8/2009 Tourwe
7,613,314 B2 11/2009 Camp, Jr.
7,676,048 B2 3/2010 Tsutsui
7,711,442 B2 5/2010 Ryle et al.
1,264,800 A1 7/2010 Bongiovi
7,778,718 B2 8/2010 Janke et al.
7,916,876 B1 3/2011 Helsloot
1,272,765 A1 9/2011 Hicks et al.
8,068,621 B2 11/2011 Okabayashi et al.
8,160,274 B2 4/2012 Bongiovi
8,175,287 B2 5/2012 Ueno et al.
8,229,136 B2 7/2012 Bongiovi
8,284,955 B2 10/2012 Bongiovi et al.
8,462,963 B2 6/2013 Bongiovi
8,472,642 B2 6/2013 Bongiovi
8,503,701 B2 8/2013 Miles et al.
8,565,449 B2 10/2013 Bongiovi
8,705,765 B2 4/2014 Bongiovi
8,879,743 B1 * 11/2014 Mitra ..... H04R 1/342 181/129
9,195,433 B2 11/2015 Bongiovi et al.
9,264,004 B2 2/2016 Bongiovi et al.
9,276,542 B2 3/2016 Bongiovi et al.
9,281,794 B1 3/2016 Bongiovi et al.
9,344,828 B2 5/2016 Bongiovi et al.
9,348,904 B2 5/2016 Bongiovi et al.
9,350,309 B2 5/2016 Bongiovi et al.
9,397,629 B2 7/2016 Bongiovi et al.
9,398,394 B2 7/2016 Bongiovi et al.
2001/0008535 A1 7/2001 Lanigan
2001/0043704 A1 11/2001 Schwartz
2002/0057808 A1 5/2002 Goldstein
2002/0094096 A1 7/2002 Paritsky et al.
2003/0016838 A1 1/2003 Paritsky et al.
2003/0023429 A1 1/2003 Claesson
2003/0035555 A1 2/2003 King et al.
2003/0043940 A1 3/2003 Janky et al.
2003/0112088 A1 6/2003 Bizjak
2003/0138117 A1 7/2003 Goff
2003/0142841 A1 7/2003 Wiegand
2003/0164546 A1 9/2003 Giger
2003/0179891 A1 9/2003 Rabinowitz et al.
2003/0216907 A1 11/2003 Thomas
2004/0003805 A1 1/2004 Ono et al.
2004/0022400 A1 2/2004 Magrath
2004/0044804 A1 3/2004 MacFarlane
2004/0086144 A1 5/2004 Kallen
2004/0138769 A1 7/2004 Akiho
2004/0146170 A1 7/2004 Zint
2005/0090295 A1 4/2005 Ali et al.
2005/0117771 A1 6/2005 Vosburgh et al.
2005/0129248 A1 6/2005 Kraemer et al.
2005/0175185 A1 8/2005 Korner
2005/0201572 A1 9/2005 Lindahl et al.
2005/0249272 A1 11/2005 Kirkeby et al.
2005/0254564 A1 11/2005 Tsutsui
2006/0034467 A1 2/2006 Sleboda et al.

(56) References Cited

U.S. PATENT DOCUMENTS

| | | | |
|---|---|---|---|
| 2006/0064301 | A1 | 3/2006 | Aguilar et al. |
| 2006/0098827 | A1 | 5/2006 | Paddock et al. |
| 2006/0126851 | A1 | 6/2006 | Yuen et al. |
| 2006/0126865 | A1 | 6/2006 | Blamey et al. |
| 2006/0138285 | A1 | 6/2006 | Oleski et al. |
| 2006/0140319 | A1 | 6/2006 | Eldredge et al. |
| 2006/0291670 | A1 | 12/2006 | King et al. |
| 2007/0010132 | A1 | 1/2007 | Nelson |
| 2007/0119421 | A1 | 5/2007 | Lewis et al. |
| 2007/0173990 | A1 | 7/2007 | Smith et al. |
| 2007/0177459 | A1 | 8/2007 | Behn |
| 2007/0206643 | A1 | 9/2007 | Egan |
| 2007/0223713 | A1 | 9/2007 | Gunness |
| 2007/0223717 | A1 | 9/2007 | Boersma |
| 2007/0253577 | A1 | 11/2007 | Yen et al. |
| 2008/0031462 | A1 | 2/2008 | Walsh et al. |
| 2008/0040116 | A1 | 2/2008 | Cronin |
| 2008/0069385 | A1 | 3/2008 | Revit |
| 2008/0112576 | A1 | 5/2008 | Bongiovi |
| 2008/0123870 | A1 | 5/2008 | Stark |
| 2008/0123873 | A1 | 5/2008 | Bjorn-Josefsen et al. |
| 2008/0137881 | A1 | 6/2008 | Bongiovi |
| 2008/0165989 | A1 | 7/2008 | Seil et al. |
| 2008/0181424 | A1 | 7/2008 | Schulein et al. |
| 2008/0219459 | A1 | 9/2008 | Bongiovi et al. |
| 2008/0255855 | A1 | 10/2008 | Lee et al. |
| 2009/0022328 | A1 | 1/2009 | Neugebauer et al. |
| 2009/0054109 | A1 | 2/2009 | Hunt |
| 2009/0062946 | A1 | 3/2009 | Bongiovi et al. |
| 2009/0086996 | A1 | 4/2009 | Bongiovi et al. |
| 2009/0282810 | A1 | 11/2009 | Leone et al. |
| 2009/0290725 | A1 | 11/2009 | Huang |
| 2009/0296959 | A1 | 12/2009 | Bongiovi |
| 2010/0166222 | A1 | 7/2010 | Bongiovi |
| 2010/0256843 | A1 | 10/2010 | Bergstein et al. |
| 2010/0278364 | A1 | 11/2010 | Berg |
| 2010/0303278 | A1 | 12/2010 | Sahyoun |
| 2011/0013736 | A1 | 1/2011 | Tsukamoto et al. |
| 2011/0087346 | A1 | 4/2011 | Larsen et al. |
| 2011/0194712 | A1 | 8/2011 | Potard |
| 2011/0230137 | A1 | 9/2011 | Hicks |
| 2011/0257833 | A1 | 10/2011 | Trush et al. |
| 2012/0014553 | A1 | 1/2012 | Bonanno |
| 2012/0099741 | A1 | 4/2012 | Gotoh et al. |
| 2012/0170759 | A1 | 7/2012 | Yuen et al. |
| 2012/0213034 | A1 | 8/2012 | Imran |
| 2012/0213375 | A1 | 8/2012 | Mahabub et al. |
| 2012/0302920 | A1 | 11/2012 | Bridger et al. |
| 2013/0121507 | A1 | 5/2013 | Bongiovi et al. |
| 2013/0162908 | A1 | 6/2013 | Son et al. |
| 2013/0163783 | A1 | 6/2013 | Burlingame |
| 2013/0169779 | A1 | 7/2013 | Pedersen |
| 2013/0220274 | A1 | 8/2013 | Deshpande et al. |
| 2013/0227631 | A1 | 8/2013 | Sharma et al. |
| 2013/0242191 | A1 | 9/2013 | Leyendecker |
| 2013/0288596 | A1 | 10/2013 | Suzuki et al. |
| 2013/0338504 | A1 | 12/2013 | Demos et al. |
| 2014/0067236 | A1 | 3/2014 | Henry et al. |
| 2014/0100682 | A1 | 4/2014 | Bongiovi |
| 2014/0112497 | A1 | 4/2014 | Bongiovi et al. |
| 2014/0153765 | A1 | 6/2014 | Gan et al. |
| 2014/0185829 | A1 | 7/2014 | Bongiovi |
| 2014/0261301 | A1 | 9/2014 | Leone |
| 2014/0369504 | A1 | 12/2014 | Bongiovi et al. |
| 2014/0379355 | A1 | 12/2014 | Hosokawsa |
| 2015/0215720 | A1 | 7/2015 | Carroll |
| 2015/0297169 | A1 | 10/2015 | Copt et al. |
| 2015/0297170 | A1 | 10/2015 | Copt et al. |
| 2016/0036402 | A1 | 2/2016 | Bongiovi et al. |
| 2016/0044436 | A1 | 2/2016 | Copt et al. |
| 2016/0240208 | A1 | 8/2016 | Bongiovi et al. |
| 2016/0258907 | A1 | 9/2016 | Butera, III et al. |
| 2016/0344361 | A1 | 11/2016 | Bongiovi et al. |
| 2017/0033755 | A1 | 2/2017 | Bongiovi et al. |
| 2017/0041732 | A1 | 2/2017 | Bongiovi et al. |

FOREIGN PATENT DOCUMENTS

| | | | |
|---|---|---|---|
| AU | 2012202127 | | 7/2014 |
| CA | 2533221 | | 6/1995 |
| CA | 2576829 | | 7/2014 |
| EP | 0206746 | B1 | 8/1992 |
| EP | 0666012 | | 11/2002 |
| EP | 2814267 | B1 | 10/2016 |
| GB | 2003707 | A | 3/1979 |
| GB | 2320393 | | 12/1996 |
| ID | P0031074 | | 6/2012 |
| IN | 260362 | | 4/2014 |
| IS | 198914 | | 7/2014 |
| JP | 2007106876 | | 4/1995 |
| JP | 1020040022442 | | 3/2004 |
| KR | 1020090101209 | | 9/2009 |
| NZ | 553744 | | 1/2009 |
| NZ | 574141 | | 4/2010 |
| NZ | 557201 | | 5/2012 |
| PH | 12009501073 | | 11/2014 |
| SG | 200903598-1 | | 11/2007 |
| SG | 152762 | | 12/2011 |
| SG | 155213 | | 2/2013 |
| WO | WO 9311637 | | 6/1993 |
| WO | WO 9535628 | | 12/1995 |
| WO | WO 9708847 | | 3/1997 |
| WO | WO 9709698 | | 3/1997 |
| WO | WO 9709840 | | 3/1997 |
| WO | WO 9709842 | | 3/1997 |
| WO | WO 9709843 | | 3/1997 |
| WO | WO 9709845 | | 3/1997 |
| WO | WO 9709846 | | 3/1997 |
| WO | WO 9709848 | | 3/1997 |
| WO | WO 9709849 | | 3/1997 |
| WO | WO 9709852 | | 3/1997 |
| WO | WO 9709853 | | 3/1997 |
| WO | WO 9709854 | | 3/1997 |
| WO | WO 9709855 | | 3/1997 |
| WO | WO 9709856 | | 3/1997 |
| WO | WO 9709857 | | 3/1997 |
| WO | WO 9709858 | | 3/1997 |
| WO | WO 9709859 | | 3/1997 |
| WO | WO 9709861 | | 3/1997 |
| WO | WO 9709862 | | 3/1997 |
| WO | WO 9831188 | | 7/1998 |
| WO | WO 9834320 | | 8/1998 |
| WO | WO 9839947 | | 9/1998 |
| WO | WO 9843464 | | 10/1998 |
| WO | WO 9852381 | | 11/1998 |
| WO | WO 9852383 | | 11/1998 |
| WO | WO 9853638 | | 11/1998 |
| WO | WO 9902012 | | 1/1999 |
| WO | WO 9908479 | | 2/1999 |
| WO | WO 9912387 | | 3/1999 |
| WO | WO 9913684 | | 3/1999 |
| WO | WO 9921397 | | 4/1999 |
| WO | WO 9937121 | | 7/1999 |
| WO | WO 9938155 | | 7/1999 |
| WO | WO 9952322 | | 10/1999 |
| WO | WO 9952324 | | 10/1999 |
| WO | WO 9956497 | | 11/1999 |
| WO | WO 9962294 | | 12/1999 |
| WO | WO 9965274 | | 12/1999 |
| WO | WO 0015003 | | 3/2000 |
| WO | WO 03104924 | | 12/2003 |
| WO | WO 2006020427 | | 2/2006 |
| WO | WO 2007092420 | | 8/2007 |
| WO | WO 2008067454 | | 6/2008 |
| WO | WO 2009070797 | | 6/2009 |
| WO | WO 2009114746 | | 9/2009 |
| WO | WO 2009155057 | | 12/2009 |
| WO | WO 2010027705 | | 3/2010 |
| WO | WO 2010051354 | | 5/2010 |
| WO | WO 2011081965 | | 7/2011 |
| WO | WO 2013055394 | | 4/2013 |
| WO | WO 2013076223 | | 5/2013 |
| WO | WO2014021103 | | 12/2014 |
| WO | WO 2014201103 | | 12/2014 |

(56) References Cited

FOREIGN PATENT DOCUMENTS

| | | |
|---|---|---|
| WO | WO 2015061393 | 4/2015 |
| WO | WO 2015077681 | 5/2015 |
| WO | WO2016144861 | 9/2016 |

* cited by examiner

ARTIFICIAL EAR APPARATUS AND ASSOCIATED METHODS FOR GENERATING A HEAD RELATED AUDIO TRANSFER FUNCTION

CLAIM OF PRIORITY

The present application is based on and a claim of priority is made under 35 U.S.C. Section 119(e) to a provisional patent application that is in the U.S. Patent and Trademark Office, namely, that having Ser. No. 62/035,025 and a filing date of Aug. 8, 2014, and which is incorporated herein by reference.

FIELD OF THE INVENTION

The present invention provides for a system and apparatus for generating a real time head related audio transfer function. Specifically, unique structural components are utilized in connection with a microphone to reproduce certain acoustic characteristics of the human pinna in order to facilitate the communication of the location of a sound in three dimensional space to a user.

BACKGROUND OF THE INVENTION

Human beings have just two ears, but can locate sounds in three dimensions, in distance and in direction. This is possible because the brain, the inner ears, and the external ears (pinna) work together to make inferences about the location of a sound. The location of a sound is estimated by taking cues derived from one ear (monaural cues), as well as by comparing the difference between the cues received in both ears (binaural cues).

Binaural cues relate to the differences of arrival and intensity of the sound between the two ears, which assist with the relative localization of a sound source. Monaural cues relate to the interaction between the sound source and the human anatomy, in which the original sound is modified by the external ear before it enters the ear canal for processing by the auditory system. The modifications encode the source location relative to the ear location and are known as head-related transfer functions (HRTF).

In other words, HRTFs describe the filtering of a sound source before it is perceived at the left and right ear drums, in order to characterize how a particular ear receives sound from a particular point in space. These modifications may include the shape of the listener's ear, the shape of the listener's head and body, the acoustical characteristics of the space in which the sound is played, and so forth. All these characteristics together influence how a listener can accurately tell what direction a sound is coming from. Thus, a pair of HRTFs accounting for all these characteristics, generated by the two ears, can be used to synthesize a binaural sound and accurately recognize it as originating from a particular point in space.

HRTFs have wide ranging applications, from virtual surround sound in media and gaming, to hearing protection in loud noise environments, and hearing assistance for the hearing impaired. Particularly, in fields including hearing protection and hearing assistance, the ability to record and reconstruct a particular user's HRTF presents several challenges as it must occur in real time. In the case of an application for hearing protection in high noise environments, heavy hearing protection hardware must be worn over the ears in the form of bulky headphones, thus, if microphones are placed on the outside of the headphones, the user will hear the outside world but will not receive accurate positional data because the HRTF is not being reconstructed. Similarly, in the case of hearing assistance for the hearing impaired, a microphone is similarly mounted external to the hearing aid, and any hearing aid device that fully blocks a user's ear canal will not accurately reproduce that user's HRTF.

Thus, there is a need for an apparatus and system for reconstructing a user's HRTF in accordance to the user's physical characteristics, in order to accurately relay positional sound information to the user in real time.

SUMMARY OF THE INVENTION

The present invention meets the existing needs described above by providing for an apparatus, system, and method for generating a head related audio transfer function. The present invention also provides for the ability to enhance audio in real-time and tailors the enhancement to the physical characteristics of a user and the acoustic characteristics of the external environment.

Accordingly, in initially broad terms, an apparatus directed to the present invention, also known as a HRTF generator, comprises an external manifold and internal manifold. The external manifold is exposed at least partially to an external environment, while the internal manifold is disposed substantially within an interior of the apparatus and/or a larger device or system housing said apparatus.

The external manifold comprises an antihelix structure, a tragus structure, and an opening. The opening is in direct air flow communication with the outside environment, and is structured to receive acoustic waves. The tragus structure is disposed to partially enclose the opening, such that the tragus structure will partially impede and/or affect the characteristics of the incoming acoustic waves going into the opening. The antihelix structure is disposed to further partially enclose the tragus structure as well as the opening, such that the antihelix structure will partially impede and/or affect the characteristics of the incoming acoustic waves flowing onto the tragus structure and into the opening. The antihelix and tragus structures may comprise semi-domes or any variation of partial-domes comprising a closed side and an open side. In a preferred embodiment, the open side of the antihelix structure and the open side of the tragus structure are disposed in confronting relations to one another.

The opening of the external manifold is connected to and in air flow communication with an opening canal inside the external manifold. The opening canal may be disposed in a substantially perpendicular orientation relative to the desired orientation of the user. The opening canal is in further air flow communication with an auditory canal, which is formed within the internal manifold but also be formed partially in the external manifold.

The internal manifold comprises the auditory canal and a microphone housing. The microphone housing is attached or connected to an end of the auditory canal on the opposite end to its connection with the opening canal. The auditory canal, or at least the portion of the portion of the auditory canal, may be disposed in a substantially parallel orientation relative to the desired listening direction of the user. The microphone housing may further comprise a microphone mounted against the end of the auditory canal. The microphone housing may further comprise an air cavity behind the microphone on an end opposite its connection to the auditory canal, which may be sealed with a cap.

In at least one embodiment, the apparatus or HRTF generator may form as part of a larger system. Accordingly, the system may comprise a left HRTF generator, a right HRTF generator, a left preamplifier, a right preamplifier, an audio processor, a left playback module, and a right playback module.

As such, the left HRTF generator may be structured to pick up and filter sounds to the left of a user. Similarly, the right HRTF generator may be structured to pick up and filter sounds to the right of the user. A left preamplifier may be structured and configured to increase the gain of the filtered sound of the left HRTF generator. A right preamplifier may be structured and configured to increase the gain of the filtered sound of the right HRTF generator. The audio processor may be structured and configured to process and enhance the audio signals received from the left and right preamplifiers, and then transmit the respective processed signals to each of the left and right playback modules. The left and right playback modules or transducers are structured and configured to convert the electrical signals into sound to the user, such that the user can then perceive the filtered and enhanced sound from the user's environment, which includes audio data that allows the user to localize the source of the originating sound.

In at least one embodiment, the system of the present invention may comprise a wearable device such as a headset or headphones having the HRTF generator embedded therein. The wearable device may further comprise the preamplifiers, audio processor, and playback modules, as well as other appropriate circuitry and components.

In a further embodiment, a method for generating a head related audio transfer function may be used in accordance with the present invention. As such, external sound is first filtered through an exterior of a HRTF generator which may comprise a tragus structure and an antihelix structure. The filtered sound is then passed to the interior of the HRTF generator, such as through the opening canal and auditory canal described above to create an input sound. The input sound is received at a microphone embedded within the HRTF generator adjacent to and connected to the auditory canal in order to create an input signal. The input signal is amplified with a preamplifier in order to create an amplified signal. The amplified signal is then processed with an audio processor, in order to create a processed signal. Finally, the processed signal is transmitted to the playback module in order to relay audio and/or locational audio data to a user.

The method described herein may be configured to capture and transmit locational audio data to a user in real time, such that it can be utilized as a hearing aid, or in loud noise environments to filter out loud noises.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE EMBODIMENT

As illustrated by the accompanying drawings, the present invention is directed to an apparatus, system, and method for generating a head related audio transfer function for a user. Specifically, some embodiments relate to capturing surrounding sound in the external environment in real time, filtering that sound through unique structures formed on the apparatus in order to generate audio positional data, and then processing that sound to enhance and relay the positional audio data to a user, such that the user can determine the origination of the sound in three dimensional space.

Figure 1:
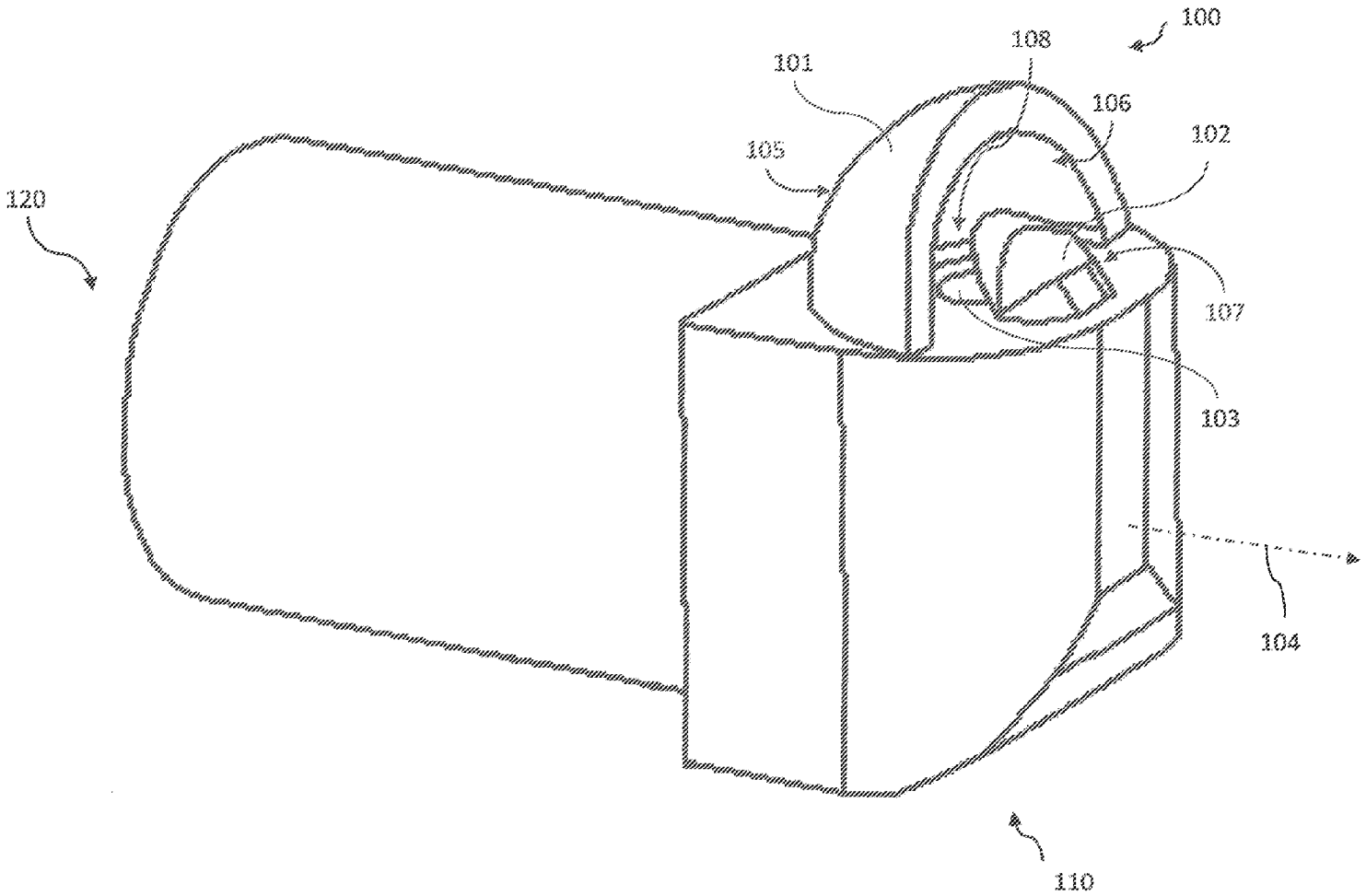
FIG. 1 is a perspective external view of an apparatus for generating a head related audio transfer function.
Figure 2:
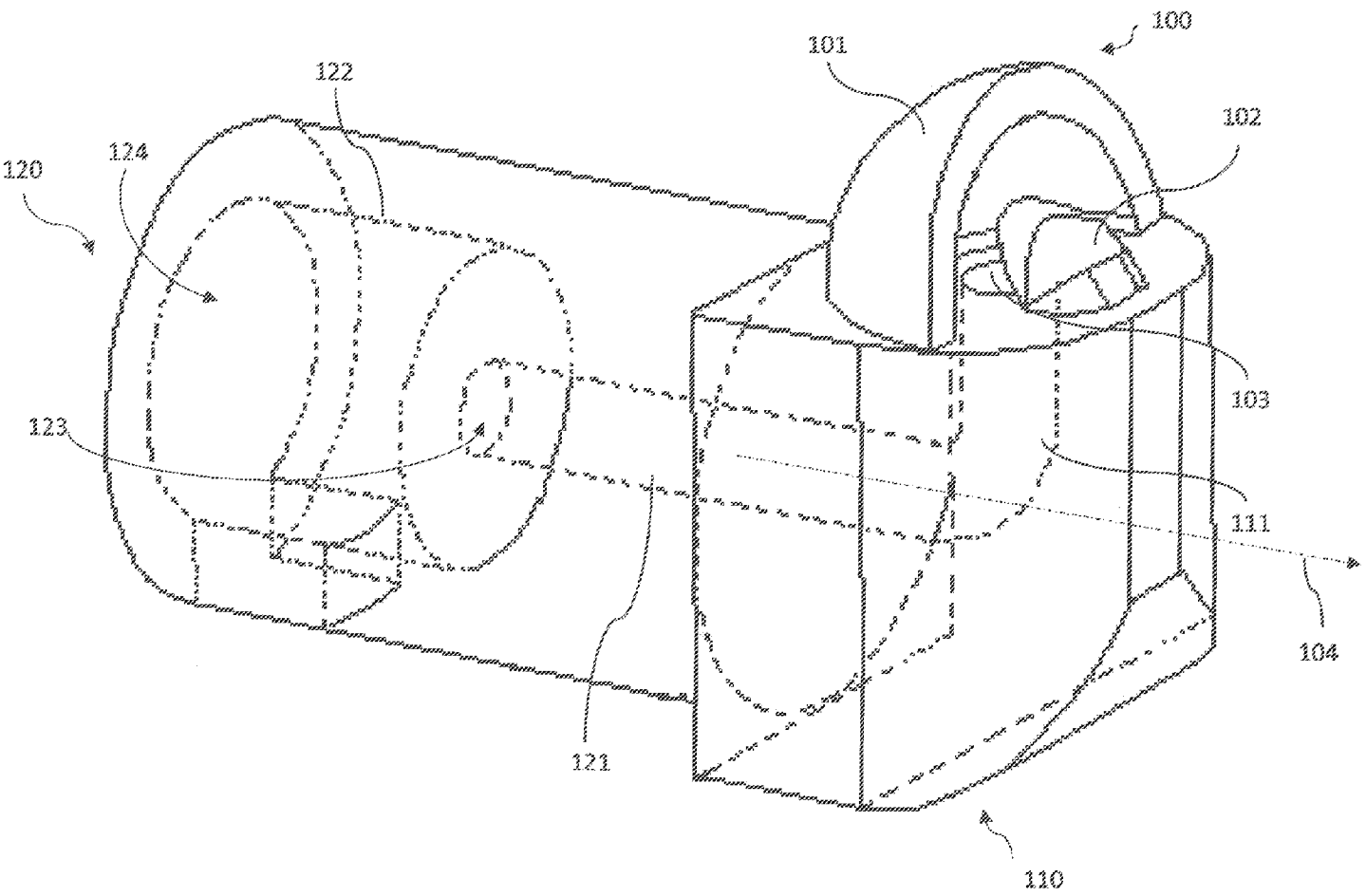
FIG. 2 is a perspective internal view of an apparatus for generating a head related audio transfer function.

As schematically represented, FIGS. 1 and 2 illustrate at least one preferred embodiment of an apparatus 100 for generating a head related audio transfer function for a user, or "HRTF generator". Accordingly, apparatus 100 comprises an external manifold 110 and an internal manifold 120. The external manifold 110 will be disposed at least partially on an exterior of the apparatus 100. The internal manifold 120, on the other hand, will be disposed along an interior of the apparatus 100. For further clarification, the exterior of the apparatus 100 comprises the external environment, such that the exterior is directly exposed to the air of the surrounding environment. The interior of the apparatus 100 comprises at least a partially sealed off environment that partially or fully obstructs the direct flow of acoustic waves.

The external manifold 110 may comprise a hexahedron shape having six faces. In at least one embodiment, the external manifold 110 is substantially cuboid. The external manifold 110 may comprise at least one surface that is concave or convex, such as an exterior surface exposed to the external environment. The internal manifold 120 may comprise a substantially cylindrical shape, which may be at least partially hollow. The external manifold 110 and internal manifold 120 may comprise sound dampening or sound proof materials, such as various foams, plastics, and glass known to those skilled in the art.

Drawing attention to FIG. 1, the external manifold 110 comprises an antihelix structure 101, a tragus structure 102, and an opening 103 that are externally visible. The opening 103 is in direct air flow communication with the surrounding environment, and as such will receive a flow of acoustic waves or vibrations in the air that passes through the opening 103. The tragus structure 102 is disposed to partially enclose the opening 103, and the antihelix structure 101 is disposed to partially enclose both the antihelix structure 102 and the opening 103.

In at least one embodiment, the antihelix structure 101 comprises a semi-dome structure having a closed side 105 and an open side 106. In a preferred embodiment, the open side 106 faces the preferred listening direction 104, and the closed side 105 faces away from the preferred listening direction 104. The tragus structure 102 may also comprise a semi-dome structure having a closed side 107 and an open side 108. In a preferred embodiment, the open side 108 faces away from the preferred listening direction 104, while the closed side 107 faces towards the preferred listening direction 104. In other embodiments, the open side 106 of the antihelix structure 101 may be in direct confronting relations to the open side 108 of the tragus structure 102, regardless of the preferred listening direction 104.

Semi-dome as defined for the purposes of this document may comprise a half-dome structure or any combination of partial-dome structures. For instance, the anti-helix structure 101 of FIG. 1 comprises a half-dome, while the tragus structure 102 comprises a partial-dome wherein the base portion may be less than that of a half-dome, but the top portion may extend to or beyond the halfway point of a half-dome to provide increased coverage or enclosure of the opening 103 and other structures. Of course, in other variations, the top portion and bottom portion of the semi-dome may vary in respective dimensions to form varying portions of a full dome structure, in order to create varying coverage of the opening 103. This allows the apparatus to produce different or enhanced acoustic input for calculating direction and distance of the source sound relative to the user.

In at least one embodiment, the antihelix structure 101 and tragus structure 102 may be modular, such that different sizes, shapes (variations of different semi-domes or partial-domes) may be swapped out based on a user's preference for particular acoustic characteristics.

Drawing attention now to FIG. 2, the opening 103 is connected to, and in air flow communication, with an opening canal 111 inside the external manifold 110. In at least one embodiment, the opening canal 111 is disposed in a substantially perpendicular orientation relative to the desired listening direction 104 of the user. The opening canal 111 is further connected in air flow communication with an auditory canal 121. A portion of the auditory canal 121 may be formed in the external manifold 110. In various embodiments, the opening canal 111 and auditory canal 121 may be of a single piece construction. In other embodiments, a canal connector not shown may be used to connect the two segments. At least a portion of the auditory canal 121 may also be formed within the internal manifold 120.

As previously discussed, the internal manifold 120 is formed wholly or substantially within an interior of the apparatus, such that it is not exposed directly to the outside air and will not be substantially affected by the external environment. In at least one embodiment, the auditory canal 121 formed within at least a portion of the internal manifold 120 will be disposed in a substantially parallel orientation relative to desired listening direction 104 of the user. In a preferred embodiment, the auditory canal comprises a length that is greater than two times its diameter.

A microphone housing 122 is attached to an end of the auditory canal 121. Within the microphone housing 122, a microphone represented schematically and generally at 123, is mounted against the end of the auditory canal 121. In at least one embodiment, the microphone 123 is mounted flush against the auditory canal 121, such that the connection may be substantially air tight to avoid interference sounds. In a preferred embodiment, an air cavity generally at 124 is created behind the microphone and at the end of the internal manifold 120. This may be accomplished by inserting the microphone 123 into the microphone housing 122, and then sealing the end of the microphone housing, generally at 124, with a cap. The cap may be substantially air tight in at least one embodiment. Different gasses having different acoustic characteristics may be used within the air cavity.

Figure 3:
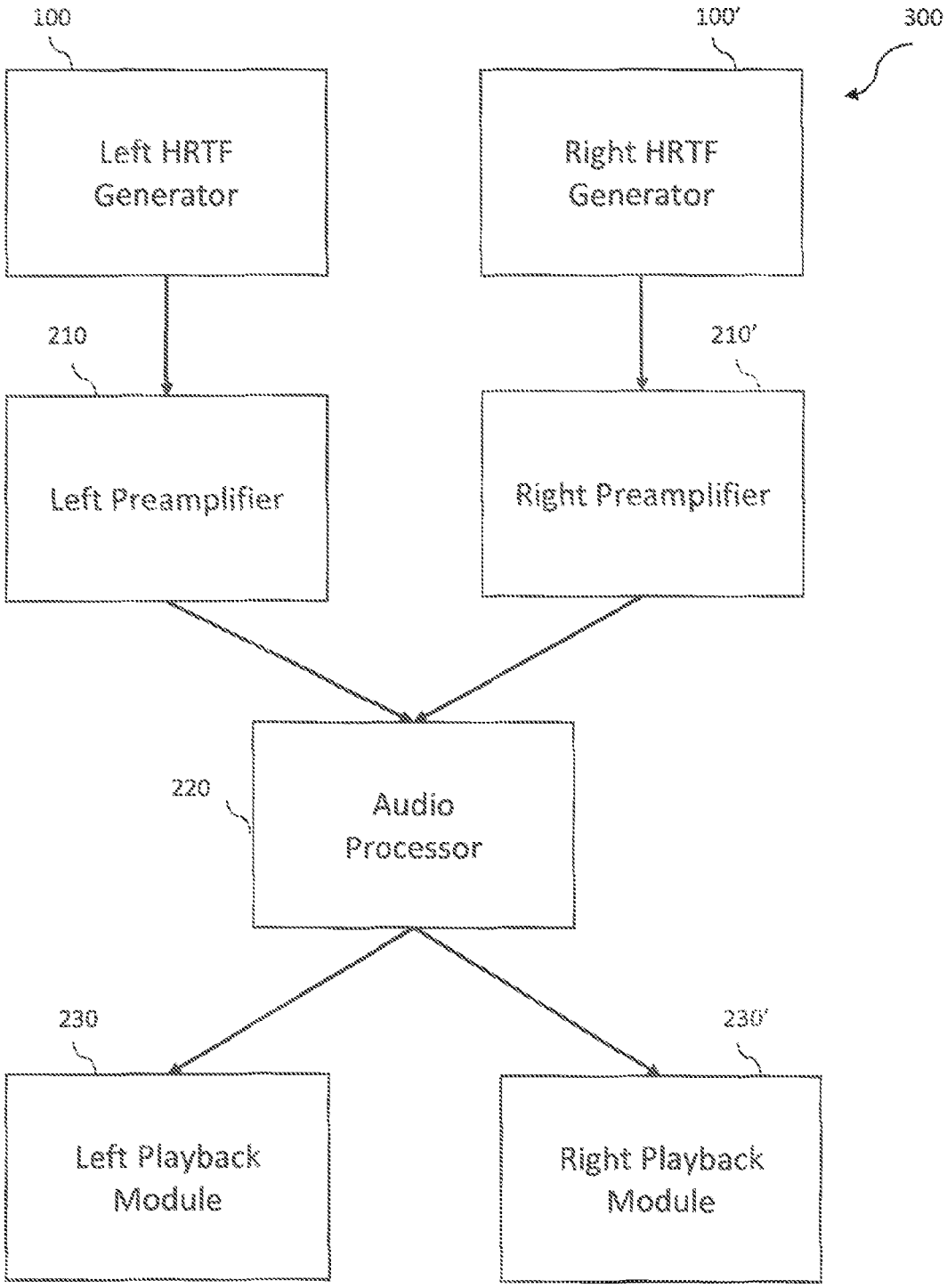
FIG. 3 is a block diagram directed to a system for generating a head related audio transfer function.

In at least one embodiment, apparatus 100 may form as part of a larger system 300 as illustrated in FIG. 3. Accordingly, a system 300 may comprise a left HRTF generator 100, a right HRTF generator 100', a left preamplifier 210, a right preamplifier 210', an audio processor 220, a left playback module 230, and a right playback module 230'.

The left and right HRTF generators 100 and 100' may comprise the apparatus 100 described above, each having unique structures such as the antihelix structure 101 and tragus structure 102. Accordingly, the HRTF generators 100/100' may be structured to generate a head related audio transfer function for a user, such that the sound received by the HRTF generators 100/100' may be relayed to the user to accurately communicate position data of the sound. In other words, the HRTF generators 100/100' may replicate and replace the function of the user's own left and right ears, where the HRTF generators would collect sound, and perform respective spectral transformations or a filtering process to the incoming sounds to enable the process of vertical localization to take place.

A left preamplifier 210 and right preamplifier 210' may then be used to enhance the filtered sound coming from the HRTF generators, in order to enhance certain acoustic characteristics to improve locational accuracy, or to filter out unwanted noise. The preamplifiers 210/210' may comprise an electronic amplifier, such as a voltage amplifier, current amplifier, transconductance amplifier, transresistance amplifier and/or any combination of circuits known to those skilled in the art for increasing or decreasing the gain of a sound or input signal. In at least one embodiment, the preamplifier comprises a microphone preamplifier configured to prepare a microphone signal to be processed by other processing modules. As it may be known in the art, microphone signals sometimes are too weak to be transmitted to other units, such as recording or playback devices with adequate quality. A microphone preamplifier thus increases a microphone signal to the line level by providing stable gain while preventing induced noise that might otherwise distort the signal.

Audio processor 230 may comprise a digital signal processor and amplifier, and may further comprise a volume control. Audio processor 230 may comprise a processor and combination of circuits structured to further enhance the audio quality of the signal coming from the microphone preamplifier, such as but not limited to shelf filters, equalizers, modulators. For example, in at least one embodiment the audio processor 230 may comprise a processor that performs the steps for processing a signal as taught by the present inventor's U.S. Pat. No. 8,160,274. Audio processor 230 may incorporate various acoustic profiles customized for a user and/or for an environment, such as those described in the present inventor's U.S. Pat. No. 8,565,449. Audio processor 230 may additionally incorporate processing suitable for high noise environments, such as those described in the present inventor's U.S. Pat. No. 8,462,963. Parameters of the audio processor 230 may be controlled and modified by a user via any means known to one skilled in the art, such as by a direct interface or a wireless communication interface.

The left playback module 230 and right playback module 230' may comprise headphones, earphones, speakers, or any other transducer known to one skilled in the art. The purpose of the left and right playback modules 230/230' is to convert the electrical audio signal from the audio processor 230 back into perceptible sound for the user. As such, moving-coil transducer, electrostatic transducer, electret transducer, or other transducer technologies known to one skilled in the art may be utilized.

Figure 4A:
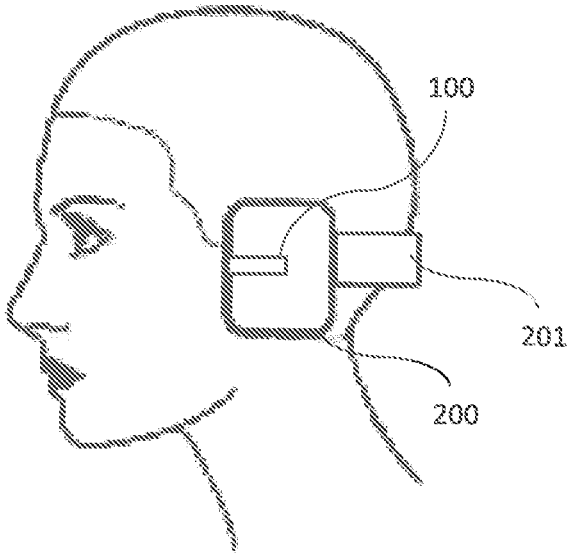
FIG. 4A illustrates a side profile view of a wearable device comprising an apparatus for generating a head related audio transfer function.
Figure 4B:
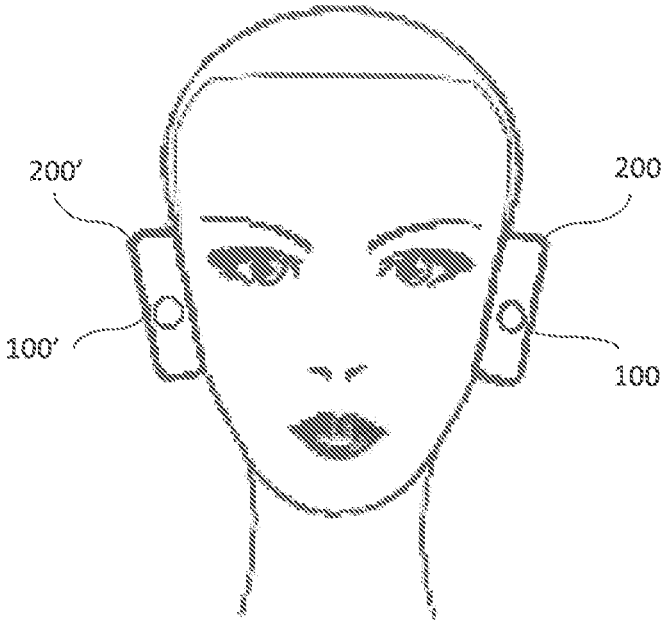
FIG. 4B illustrates a front profile view of a wearable device comprising an apparatus for generating a head related audio transfer function.

In at least one embodiment, the present system 200 comprises a device 200 as generally illustrated at FIGS. 4A and 4B, which may be a wearable headset 200 having the apparatus 100 embedded therein, as well as various amplifiers including but not limited to 210/210', processors such as 220, playback modules such as 230/230', and other appropriate circuits or combinations thereof for receiving, transmitting, enhancing, and reproducing sound.

Figure 5:
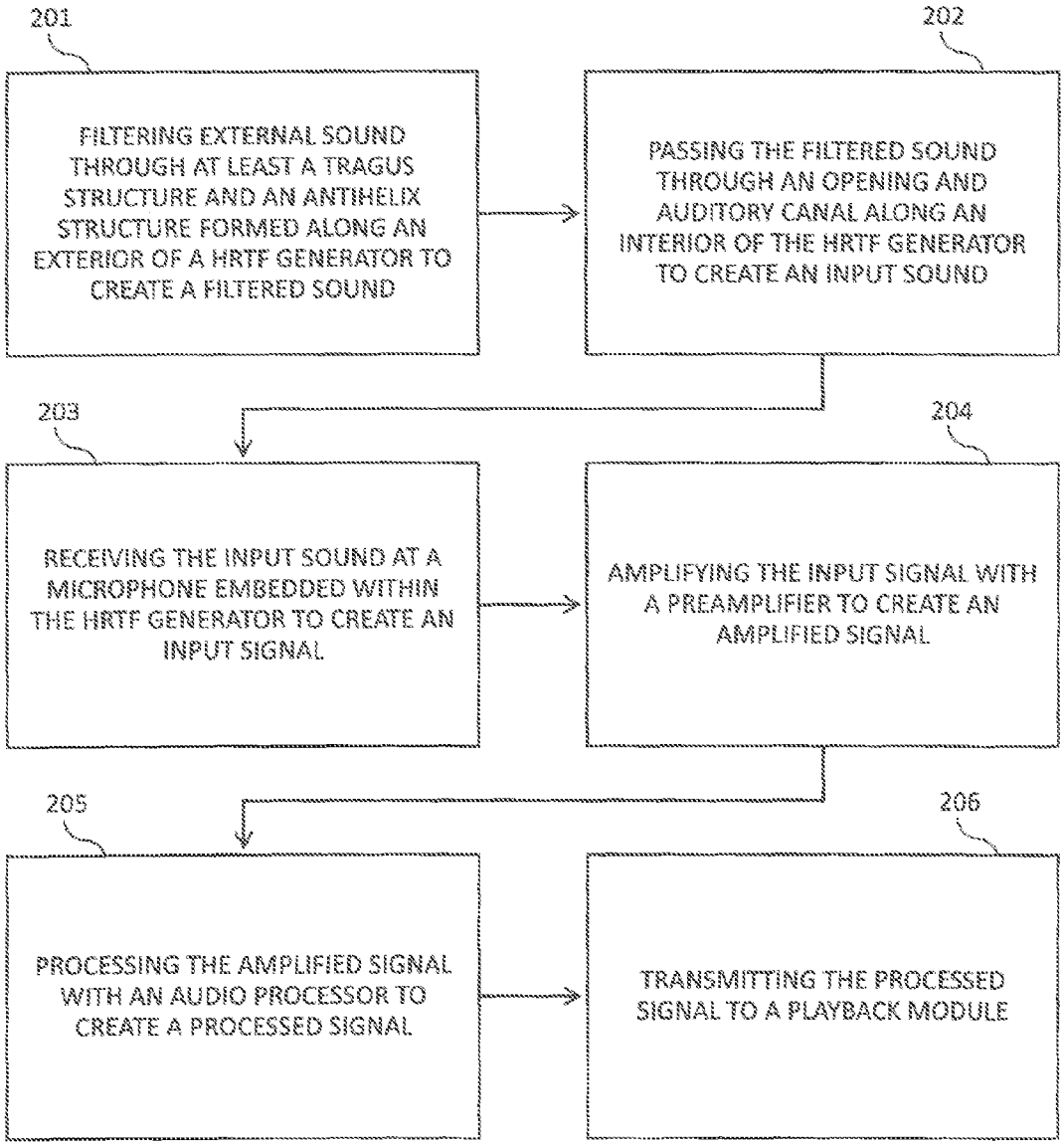
FIG. 5 illustrates a flowchart directed to a method for generating a head related audio transfer function.

In a further embodiment as illustrated in FIG. 5, a method for generating a head related audio transfer function is shown. Accordingly, external sound is first filtered through at least a tragus structure and an antihelix structure formed along an exterior of a HRTF generator, as in 201, in order to create a filtered sound. Next, the filtered sound is passed through an opening and auditory canal along an interior of the HRTF generator, as in 202, in order to create an input sound. The input sound is received at a microphone embedded within the HRTF generator, as in 203, in order to create an input signal. The input signal is then amplified with a preamplifier, as in 204, in order to create an amplified signal. The amplified signal is processed with an audio processor, as in 205, in order to create a processed signal. Finally, the processed signal is transmitted to a playback module, as in 206, in order to relay the audio and/or locational audio data to the user.

In a preferred embodiment of the present invention, the method of FIG. 5 may perform the locational audio capture and transmission to a user in real time. This facilitates usage in a hearing assistance situation, such as a hearing aid for a user with impaired hearing. This also facilitates usage in a high noise environment, such as to filter out noises and/or enhancing human speech.

In at least one embodiment, the method of FIG. 5 may further comprise a calibration process, such that each user can replicate his or her unique HRTF in order to provide for accurate localization of a sound in three dimensional space. The calibration may comprise adjusting the antihelix and tragus structures as described above, which may be formed of modular and/or moveable components. Thus, the antihelix and/or tragus structure may be repositioned, and/or differently shaped and/or sized structures may be used. In further embodiments, the audio processor 230 described above may be further calibrated to adjust the acoustic enhancement of certain sound waves relative to other sound waves and/or signals.

It should be understood that the above steps may be conducted exclusively or nonexclusively and in any order. Further, the physical devices recited in the methods may comprise any apparatus and/or systems described within this document or known to those skilled in the art.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A method for generating a head related audio transfer function (HRTF) for a user, the method comprising:

filtering external sound through at least a tragus structure and an antihelix structure formed along an exterior of a HRTF generator to create a filtered sound, passing the filtered sound through an opening and auditory canal along an interior of the HRTF generator to create an input sound, receiving the input sound at a microphone embedded within the HRTF generator to create an input signal, amplifying the input signal with a preamplifer to create an amplified signal, processing the amplified signal with an audio processor to create a processed signal, transmitting the processed signal to a playback module, calibrating the HRTF generator by repositioning the tragus structure.

2. A method as recited in claim 1 further comprising calibrating the HRTF generator by repositioning the antihelix structure.

* * * * *